US005642758A

United States Patent [19]

Palau et al.

[11] Patent Number: 5,642,758

[45] Date of Patent: Jul. 1, 1997

[54] FRAME FOR SUPPORTING THE RETURN LEVERS CONNECTED TO HEDDLE FRAMES

[75] Inventors: Joseph Palau, Duingt; Jean-Paul Froment, Doussard, both of France

[73] Assignee: Staubli Faverges, Faverges, France

[21] Appl. No.: 633,528

[22] Filed: Apr. 17, 1996

[30] Foreign Application Priority Data

Apr. 26, 1995 [FR] France ..... 95 05241

[51] Int. Cl.[6] ..... D03C 9/00

[52] U.S. Cl. ..... 139/57

[58] Field of Search ..... 139/57, 58, 30

[56] References Cited

FOREIGN PATENT DOCUMENTS 0520540 12/1992 European Pat. Off. ..... 139/57

970624 1/1951 France .

*Primary Examiner*—Andy Falik

*Attorney, Agent, or Firm*—Dowell & Dowell

[57] ABSTRACT

A frame for supporting the return levers connected to the heddle frames of a weaving system of a loom wherein the frame is in the form of an upwardly open U-shaped beam connected to a box element mounted to a support structure of the loom.

7 Claims, 6 Drawing Sheets

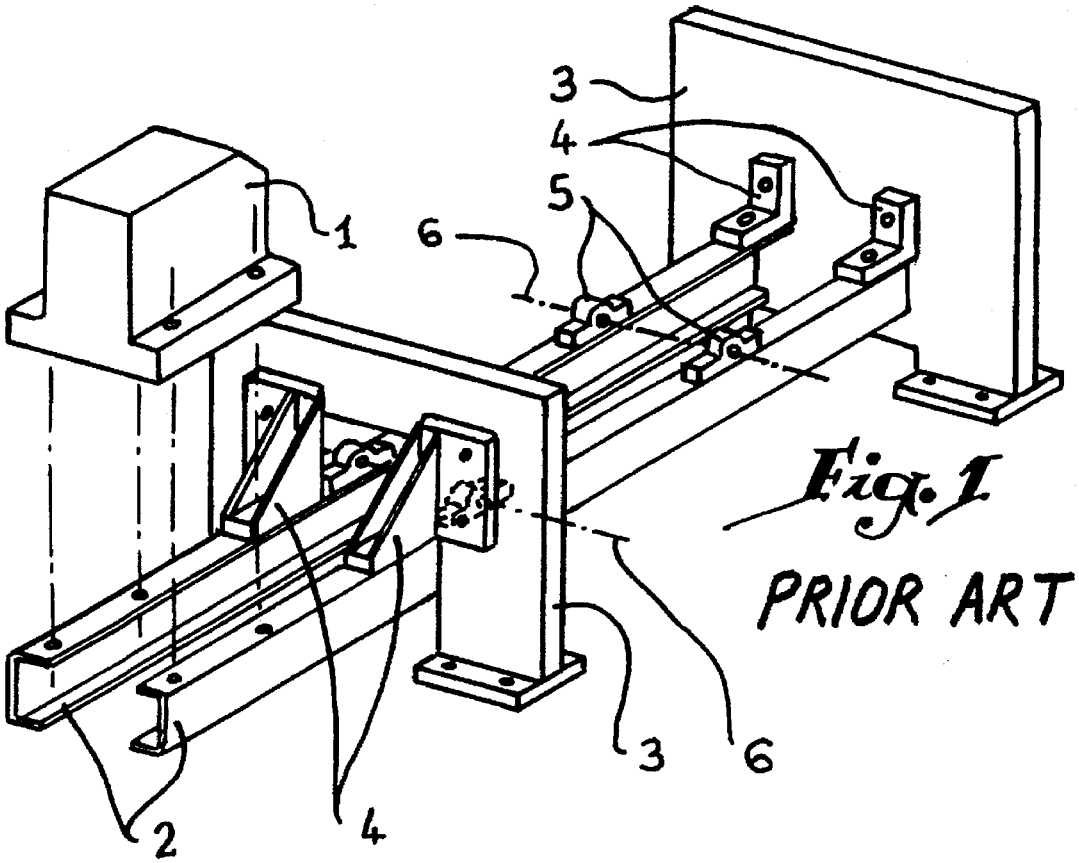
Fig. 1
PRIOR ART
PRIOR ART Fig. 2
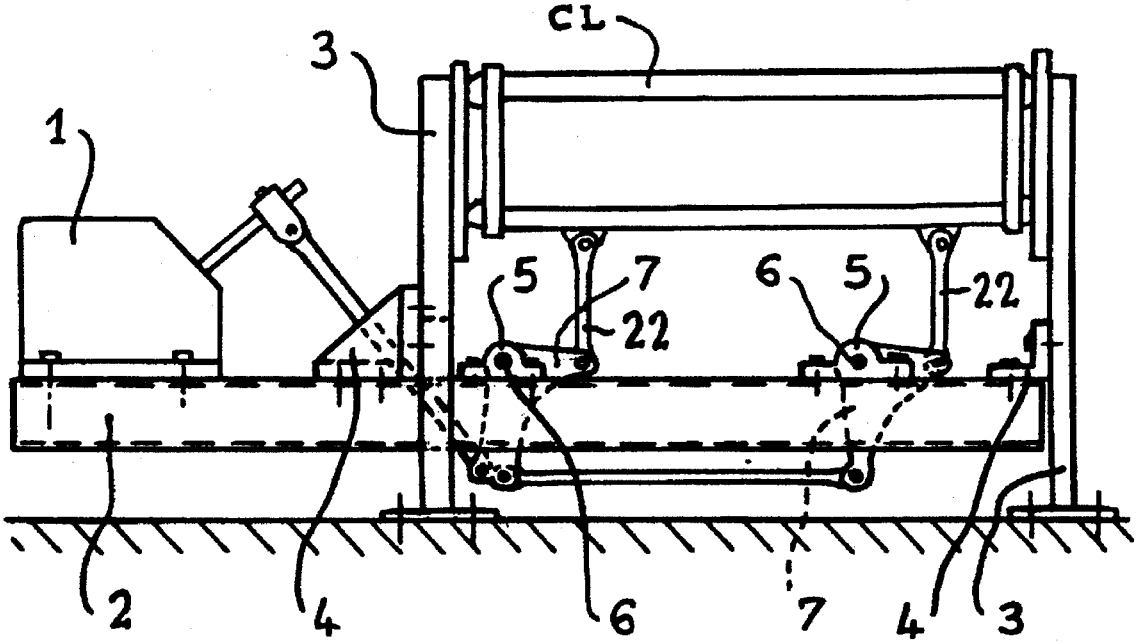

FRAME FOR SUPPORTING THE RETURN LEVERS CONNECTED TO HEDDLE FRAMES

BACKGROUND OF THE INVENTION

1. Field of the Invention

The present invention relates to dobbies and other weaving systems for forming the shed in weaving looms, and more particularly to systems of this type with single controls which are disposed laterally in lower positions with respect to the looms so as to be connected to conventional heddle frames by systems of drawing, comprising, below such frames, a plurality of return levers of substantially bracket-shaped section associated with substantially horizontal connecting rods.

2. History of the Related Art

In the conventional construction illustrated in FIGS. 1 and 2 of the accompanying drawings, the base of a conventional casing 1 of the system ordinarily rests on two iron bars 2 whose cross-section is C-shaped, open towards each other, which are secured to the vertical posts of the weaving loom by bracket-shaped members 4. Lugs 5 are mounted on the upper flange of the iron bars 2, most often by means of bolts, which lugs form supports for pivot pins 6 of return levers 7 of the drawing system which controls vertical movement of the heddle frames CL.

This conventional construction is not entirely satisfactory. Mounting the lugs 5 increases the cost of the loom. Furthermore, the assembly obtained lacks rigidity and is subject to parasitic vibrations which disturb the functioning of the system, particularly at the high speeds of weaving imposed at the present time on weaving looms.

Furthermore, it will be noted that lubrication of the joints of the drawing levers 7 is difficult, causing oil to drop, or sludge to form, beneath the weaving loom, in an area particularly difficult to clean.

It is a principal object of the present invention to overcome these drawbacks.

SUMMARY OF THE INVENTION

To that end, the invention relates to a support frame for a weaving system having a single control adapted to be placed in lower position and laterally with respect to the vertical structures of a weaving loom, wherein the control is connected to the heddle frames by a drawing system comprising, below such frames, a plurality of series of return levers with substantially bracket-shaped cross-sections associated with substantially horizontal connecting rods, characterized in that it is constituted by a single piece of U-shaped cross-section open at its ends and upwardly and whose longitudinal flanges bear the pivot pins of at least certain of the return levers of the drawing system.

In other words, the invention consists in mounting the pivot pins of the return levers on the lateral flanges of a support frame formed by a single piece of U-shaped cross-section open at its ends and upwardly.

BRIEF DESCRIPTION OF THE DRAWINGS

The invention will be more readily understood on reading the following description with reference to the accompanying drawings, in which:

As indicated hereinabove, FIGS. 1 and 2 illustrate the traditional assembly of conventional dobbies or weaving systems.

FIGS. 5 and 6 are schematic longitudinal sections showing on a larger scale the connection of each of the two ends of the support frame to the vertical structures of a weaving loom; wherein.

DESCRIPTION OF PREFERRED EMBODIMENT

Figure 3:
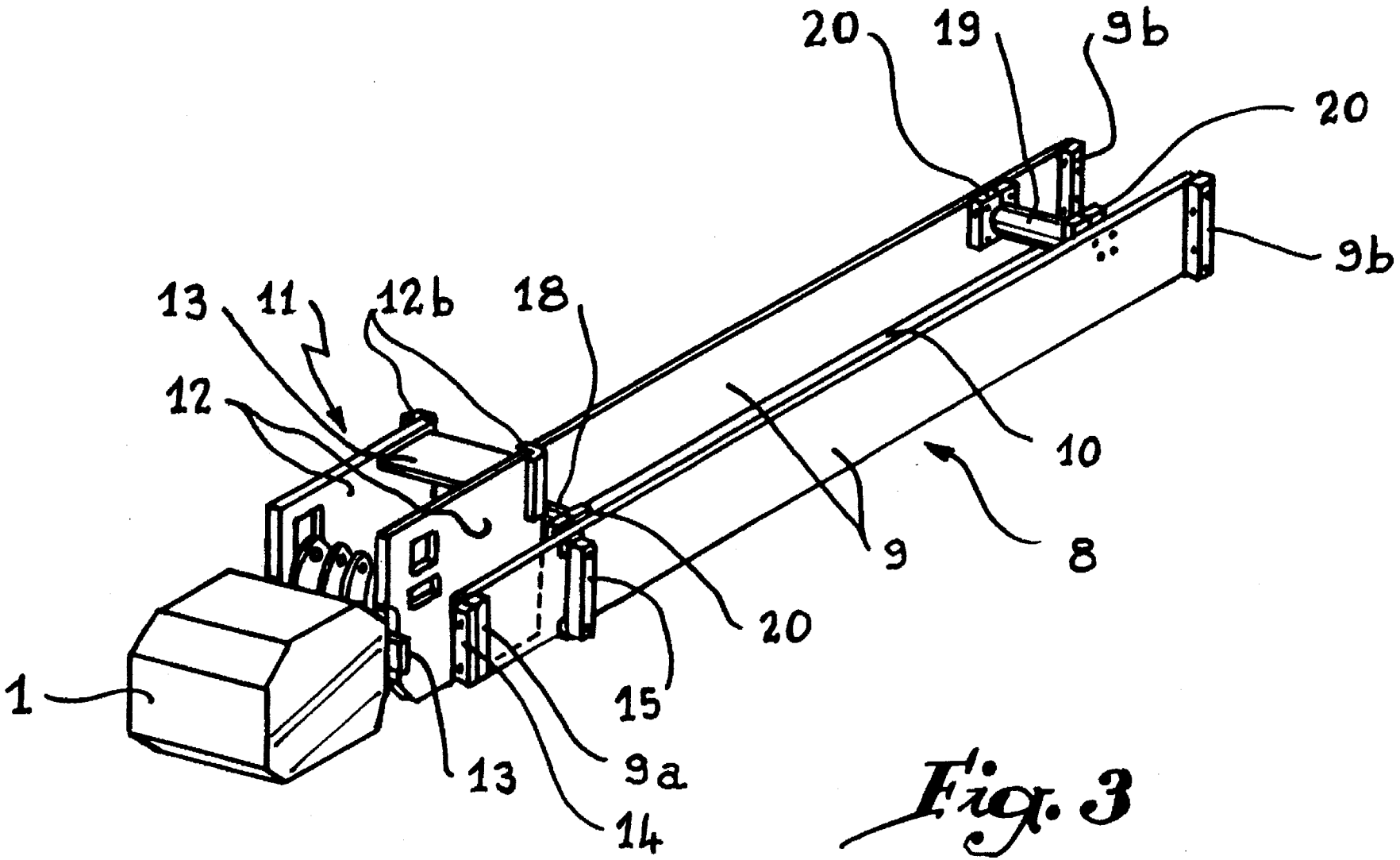
FIG. 3 is a view in perspective of a support frame according to the invention before the drawing system associated therewith has been installed.
Figure 4:
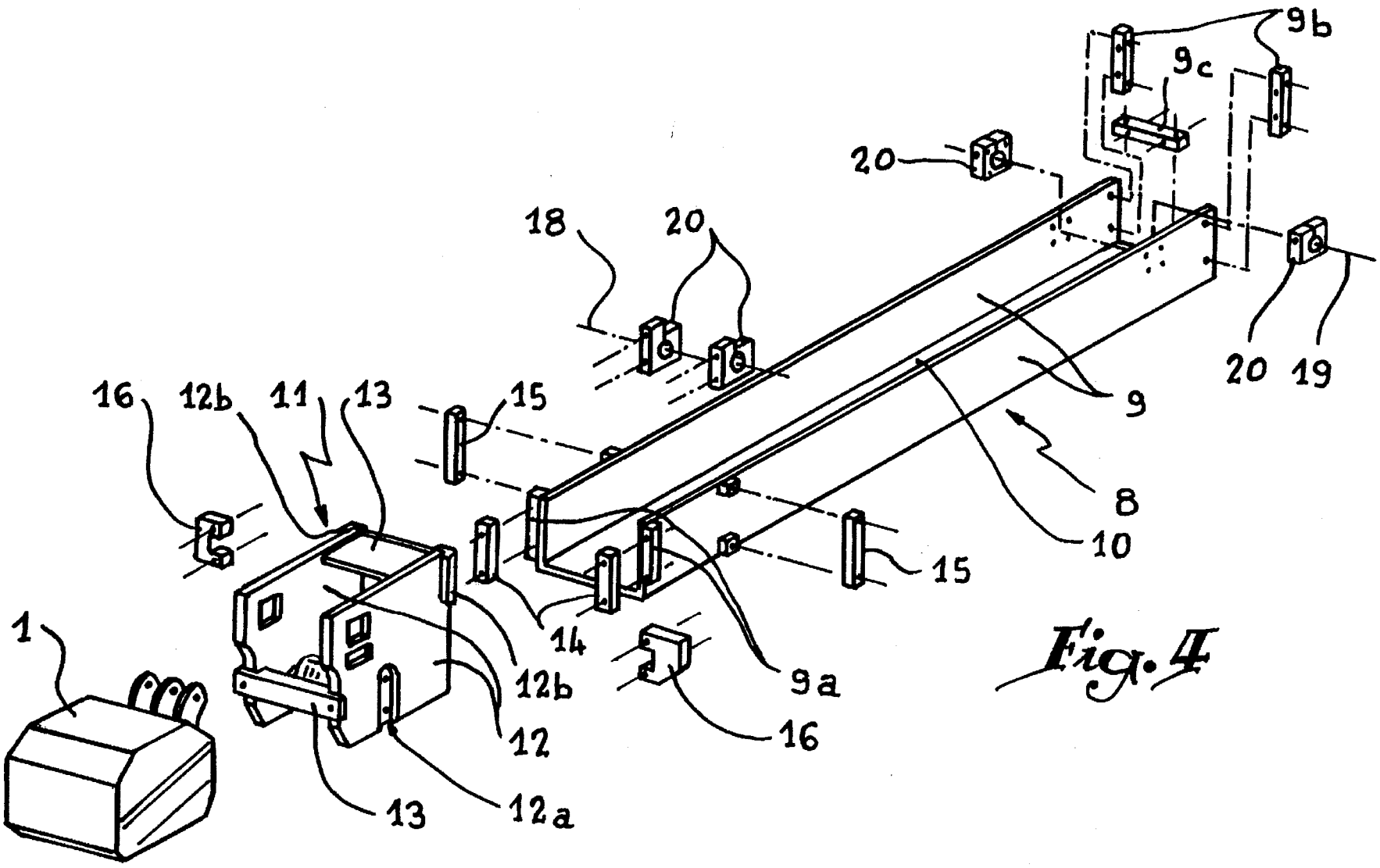
FIG. 4 illustrates in perspective the different parts which make up the support frame of FIG. 3, before they are assembled.

Referring again to the drawings, the support frame illustrated in FIGS. 3 and 4 comprises a principal beam 8 whose cross-section is in the form of an upwardly open U, which in the embodiment shown is formed by a metal sheet of considerable thickness bent twice at right angles to define two vertical flanges 9 disposed on either side of a base 10.

In one of the ends of the beam 8 there is engaged and fixed a sturdy box element 11 constituted by two vertical side walls 12 joined by crosspieces 13. The box 11 and the U-shaped beam 8 are assembled with the aid of vertical flanges **9*a* secured to the vertical edges 9 of the beam, and of mating flanges 14 added in lateral depressions 12*a* in the side walls 12 of the box element 11**.

The support frame 8-11 thus produced is intended to be supported and fixed at the base of the conventional vertical structures 3 of the weaving loom.

Figure 7:
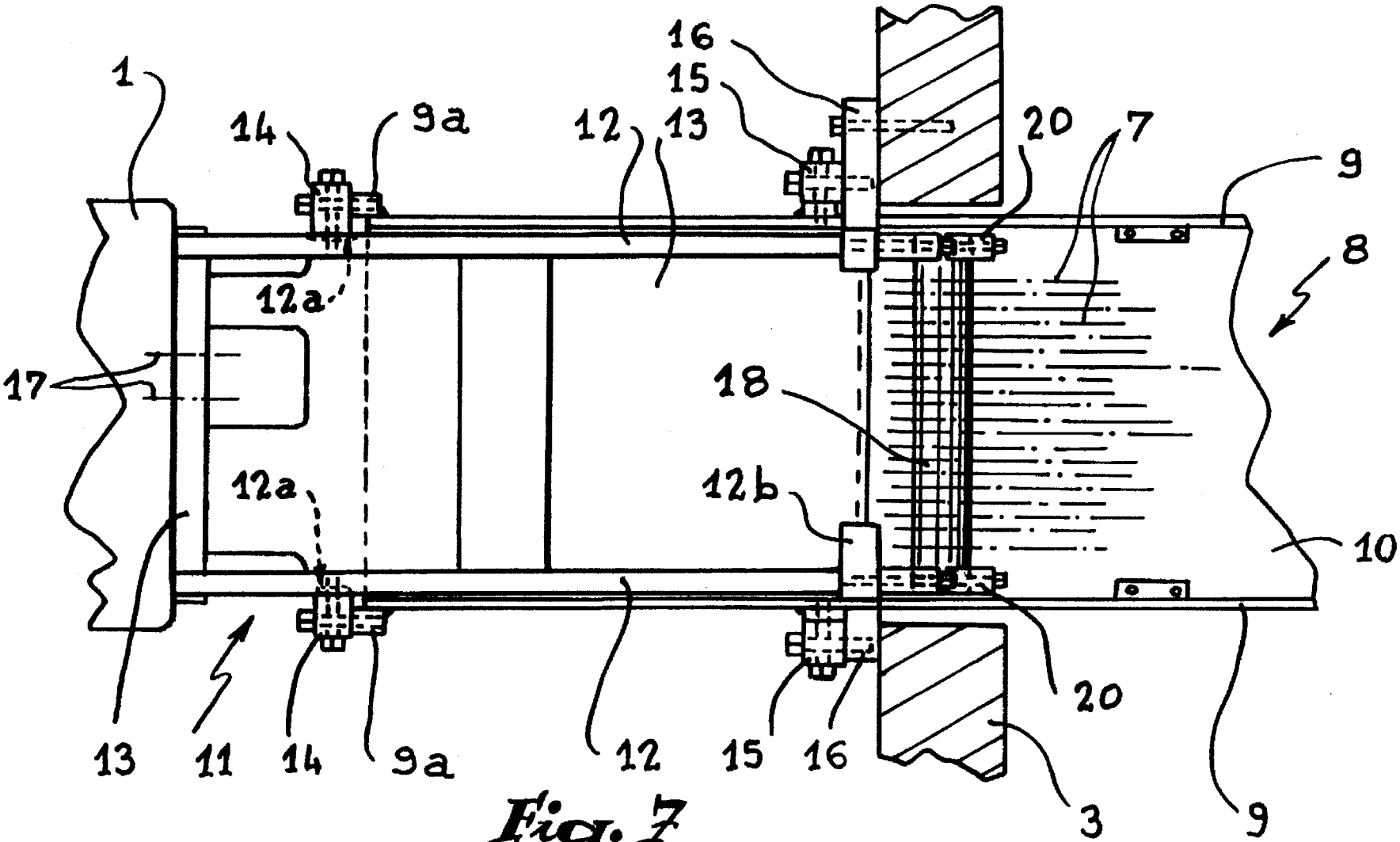

For that end of the support frame facing the box element 11, mounting is effected by means of flanges 15 (FIGS. 4, 5 and 7) which are secured to the side flanges 9 of the beam 8 on which are secured lugs 16, which are also secured to the side walls 12 of the box element 11 and to the structure 3. Two upper flanges **12*b* of the side walls 12 are bolted to the structure 3** in order to reinforce and rigidify the assembly.

Figure 6:
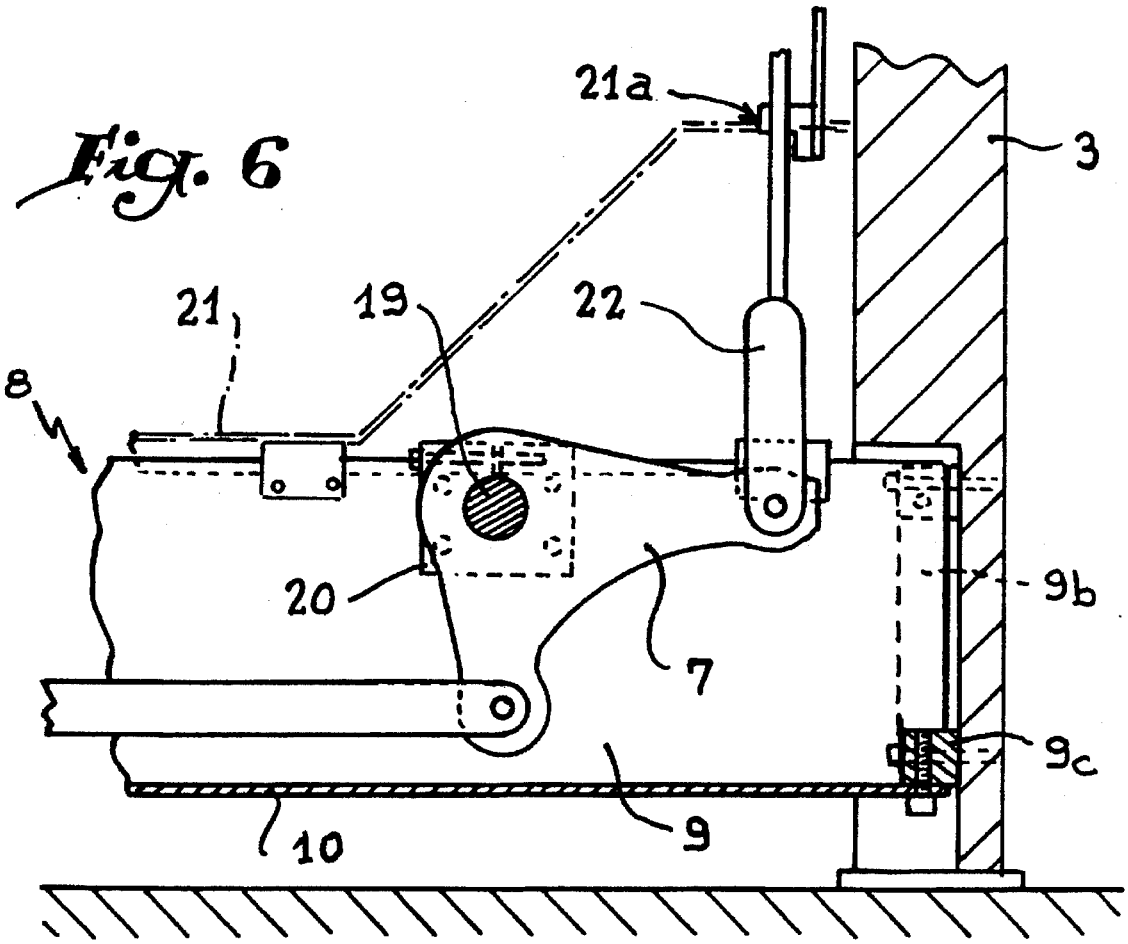

The opposite end of the beam 8 is equipped with two vertical flanges **9*b* (FIGS. 6 and 7) which are directly connected to the other vertical post structure 3, such connection being completed by a spaced piece 9*c* fixed to the base 10 of the beam 8 and to the structure 3**.

Figure 5:
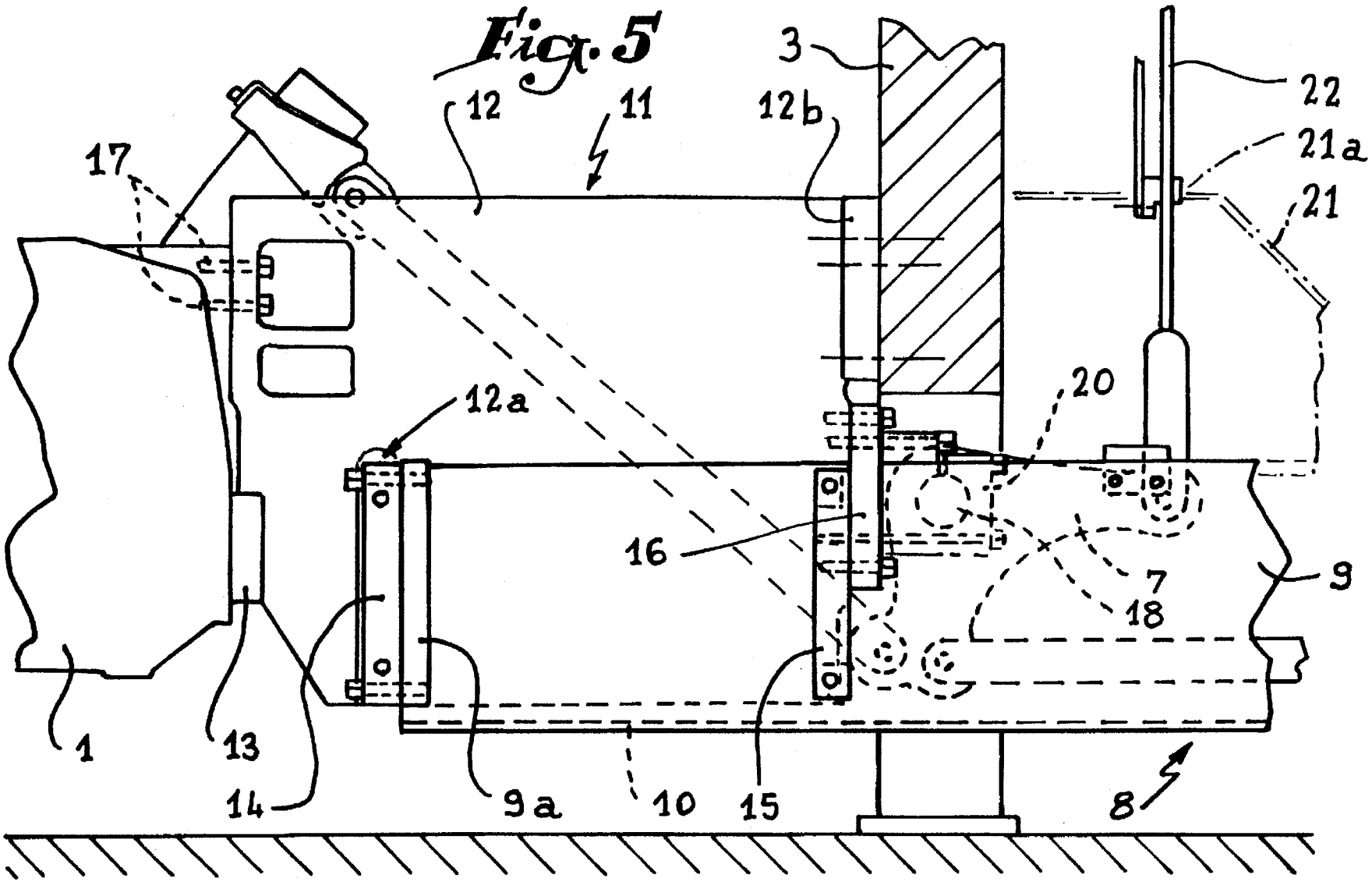

The weaving system 1 is mounted to the assembly 8-11 thus fixed to the structures 3 of the loom (FIGS. 3, 4 and 5). Such fastening is effected with the aid of the lower crosspiece 13 of the box element 11 and by means of upper tie-rods referenced 17 in FIG. 5.

Figure 8:
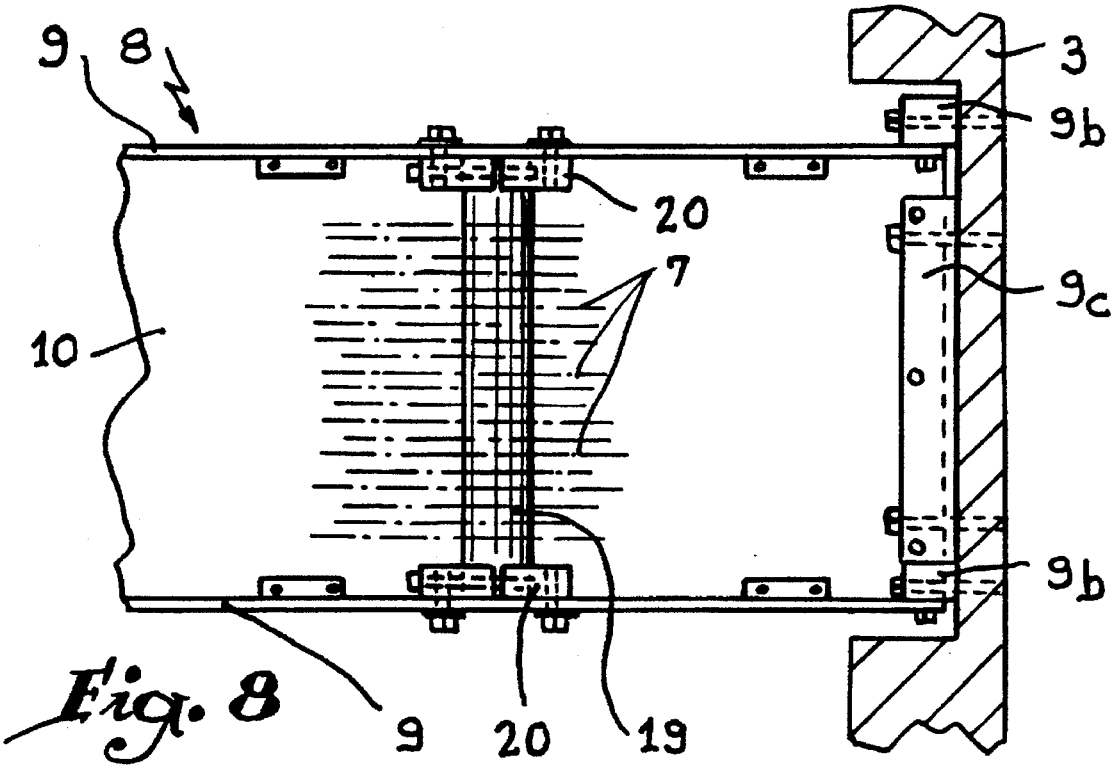
FIGS. 7 and 8 are corresponding horizontal sections.

The articulated assembly of the return levers 7 of the drawing system are mounted to two transverse pins 19 and 18 (FIGS. 6, 7 and 8) which are carried by bearings 20 fixed to the side flanges 9 of the beam 8 and to lugs 16, respectively.

The drawing system is protected by a removable cover 21 which has openings **21*a* therein (FIGS. 5 and 6) for the passage of the vertical rods 22 associated with the heddle frames CL and return levers 7**.

It will be appreciated that a very robust and very rigid construction is finally obtained, which opposes the creation of any parasitic vibrations, whatever the operating rate of the system 1. The support frame 8-11 according to the invention may be very easily assembled against the structures 3 of the loom.

It will be appreciated that, although the presence of the box element 11 interposed, in the manner of an interface, between the U-shaped beam 8 and the system 1 seems particularly advantageous due to the reinforcement obtained, it is, however, not indispensable, as the beam 8 may directly form a support for mounting the system, if its strength is sufficient.

What is claimed is:

1. In a weaving loom having vertically extending support structures to which heddle frames are moveably mounted and in which the heddle frames are connected to return levers of a drawing system, the improvement comprising, a generally U-shaped beam having bottom and opposing side walls and first and second end portions, said opposing side walls having upper and lower portions, means for mounting said beam to the vertical support structures, and pivot pins extending between and supported by said side walls of said beam for mounting the return levers to said beam.

2. The improvement of claim 1 wherein said means for mounting said beam to the vertical support structures includes a box element having opposing walls, securing means for mounting said side walls of said beam adjacent said first end portion thereof to said opposing side walls of said box element and fastening means for mounting said box element to one of the vertical support structures.

3. The improvement of claim 2 wherein said means for mounting said beam includes second fastening means for securing said second end portion thereof to another of the vertical support structures.

4. The improvement of claim 3 including a cover assembly mounted to said upper portions of said opposing side walls of said beam.

5. The improvement of claim 4 wherein said pivot pins are mounted within spaced bearings mounted to said opposing side walls of said beam.

6. The improvement of claim 1 wherein said pivot pins are mounted within spaced bearings mounted to said opposing side walls of said beam.

7. The improvement of claim 1 including a cover assembly mounted to said upper portions of said opposing side walls of said beam.

* * * * *